US008857770B2

(12) United States Patent
Ruskauff et al.

(10) Patent No.: US 8,857,770 B2
(45) Date of Patent: Oct. 14, 2014

(54) RAILWAY DARK TERRITORY SWITCH AUTOMATION

(76) Inventors: David J. Ruskauff, Geneseo, NY (US); Donald Coy Beamon, Thornton, TX (US)

( * ) Notice: Subject to any disclaimer, the term of this patent is extended or adjusted under 35 U.S.C. 154(b) by 12 days.

(21) Appl. No.: 12/291,465

(22) Filed: Nov. 10, 2008

(65) Prior Publication Data

US 2010/0127134 A1 May 27, 2010

Related U.S. Application Data

(63) Continuation-in-part of application No. 12/217,184, filed on Jul. 2, 2008, now abandoned, which is a continuation of application No. 11/028,753, filed on Jan. 3, 2005, now Pat. No. 7,416,159.

(60) Provisional application No. 61/002,725, filed on Nov. 9, 2007, provisional application No. 60/534,088, filed on Jan. 2, 2004.

(51) Int. Cl.
*B61L 7/08* (2006.01)
*B61L 11/08* (2006.01)
*B61L 7/06* (2006.01)

(52) U.S. Cl.
CPC ..... *B61L 7/065* (2013.01)
USPC ..... 246/220; 246/176; 246/253

(58) Field of Classification Search
CPC ..... B61L 5/107; B61L 25/025; B61L 17/00; B61L 25/04; B61L 1/18; B61L 1/181; B61L 23/007; B61L 23/042; B61L 5/00; B61L 5/06; B61L 5/062; B61L 7/00; B61L 7/06; B61L 7/08; B61L 11/00; B61L 11/08; B61L 13/00; B61L 13/002; B61L 13/04; B61L 2011/00; B61L 2011/08
USPC ..... 246/219, 220, 253, 162, 176, 476, 124, 246/122 R; 701/19, 20
See application file for complete search history.

(56) References Cited

U.S. PATENT DOCUMENTS

| | | | | |
|---|---|---|---|---|
| 4,023,078 | A * | 5/1977 | Olliges et al. | 361/753 |
| 5,050,823 | A * | 9/1991 | Parker | 246/5 |
| 7,416,159 | B2 * | 8/2008 | Beaman et al. | 246/219 |
| 2005/0145753 | A1 * | 7/2005 | Beaman et al. | 246/220 |

* cited by examiner

*Primary Examiner* — Mark Le
(74) *Attorney, Agent, or Firm* — Thrasher Associates

(57) ABSTRACT

The invention provides a method for a railroad switch for use in un-signalized (dark) territory utilizing multiple audio messages for control and communication purposes to operate the railroad switch and relay its position to incoming trains. The messages are triggered by a programmable logic controller in conjunction with a dual tone multiple frequency signals.

3 Claims, 4 Drawing Sheets

RADIO
D10
D12
ASR
RWP
RWP
NWP
NWP
D15
D13
Trigger
Audio 1
Audio Out
PTT
B12
N12
• NORMAL
(Locked)
Trigger
Audio 2
Audio Out
PTT
B12
N12
• REVERSE
(Locked)
Trigger
Audio 3
Audio Out
PTT
B12
N12
• NOT LINED
Trigger
Audio 4
Audio Out
PTT
B12
N12
CONTROL RECEIVED
Trigger
Audio 5
Audio Out
PTT
B12
N12
AUTO RESTORE
B12
N12
PLC-07
PLC-08
PLC-09
PLC-010
PLC-011

RAILWAY DARK TERRITORY SWITCH AUTOMATION

CROSS REFERENCE TO RELATED APPLICATIONS

The invention is related to, is a Continuation-in-Part of, and claims priority from U.S. patent application Ser. No. 12/217,184, filed on Jul. 2, 2008, which is a Continuation of U.S. patent application Ser. No. 11/028,753 filed on Jan. 3, 2005 (now U.S. Pat. No. 7,416,159 issued on Aug. 26, 2008), which claims priority to U.S. Provisional Patent Application No. 60/534,088 filed on Jan. 2, 2004, all having common inventor Beaman. The invention and this Application are also related to and claim priority from U.S. Provisional Patent Application No. 61/002,725 filed Nov. 9, 2007, also to Beaman.

FIELD OF INVENTION

The present invention relates generally to railroad infrastructure, and more particularly to railroad switches in unsignaled (dark) territory.

PROBLEM STATEMENT

Interpretation Considerations

This section describes the technical field in more detail, and discusses problems encountered in the technical field. This section does not describe prior art as defined for purposes of anticipation or obviousness under 35 U.S.C. section 102 or 35 U.S.C. section 103. Thus, nothing stated in the Problem Statement is to be construed as prior art.

Discussion

The United States rail system is currently comprised of approximately 143,000 track miles, of which, approximately only 70,000 miles are currently signaled. Signal systems are generally comprised of wayside signals, power operated switches, vital track circuits, and "vital" field logic implemented in either relay based systems, or solid state devices (note that the use of the term "vital" in this application is associated in the industry with known performance and reliability parameters, and does not mean "vital" in a patentability sense, or patent-interpretation sense, unless otherwise explicitly stated in writing). The signal systems provide for the safe control and movement of railway vehicles through the operation of the signals and switches. This control is predominantly accomplished through the use of Centralized Traffic Control (CTC) systems where a dispatcher remotely controls the signals and switches. Signal systems, CTC systems, and their components, are well known and understood in the current art. Such systems are not applied universally due to the high costs of acquisition and maintenance.

The remaining 70,000 miles of track are considered to be "dark" territory. Movement of railway vehicles in dark territory is governed by verbal authorities issued by a dispatcher thereby maintaining the safe separation and movement of the railway vehicles. Movement of railway vehicles to and from the mainline track is accomplished by the use of hand-operated manual switch stands to affect the movement of the switch points. The use of mainline hand-operated switches is governed by federal regulation 49CFR236.410 which requires, among other things, that hand-operated mainline switches remain locked in the normal position when not in use. The use of hand-operated manual switches in dark territory pose several distinct problems:

Security

Switches have inadvertently not been returned to normal, or have intentionally been tampered with, thereby unexpectedly diverting a railway vehicle from the main track. In many instances this can, and has, resulted in derailments, and, or, collisions with standing equipment.

Efficiency

One of the primary applications of hand-operated switches is to control the movements of railway vehicles to and from passing sidings. Passing sidings allow two or more railway vehicles to either meet (movement in opposing directions) or to pass (movement in same direction). These types of moves may require multiple movements of one or more of the vehicles in order to correctly position the switches, and manage the crew members.

Safety

The crew member is exposed to injury by the acts of disembarking and re-embarking the vehicle and also by the physical and climatic conditions in the vicinity of the switch.

Thus, there is a need to provide an approach for dark territory switching that provides greater security and reliability than the traditional locking mechanisms and operating practices without the use of vital communications links to a central location, or requiring a central dispatching system or requiring a vital processor.

BRIEF DESCRIPTION OF THE DRAWINGS

Various aspects of the invention, as well as an embodiment, are better understood by reference to the following detailed description. To better understand the invention, the detailed description should be read in conjunction with the drawings and tables, in which.

EXEMPLARY EMBODIMENT OF A BEST MODE

Interpretation Considerations

Figure 1:
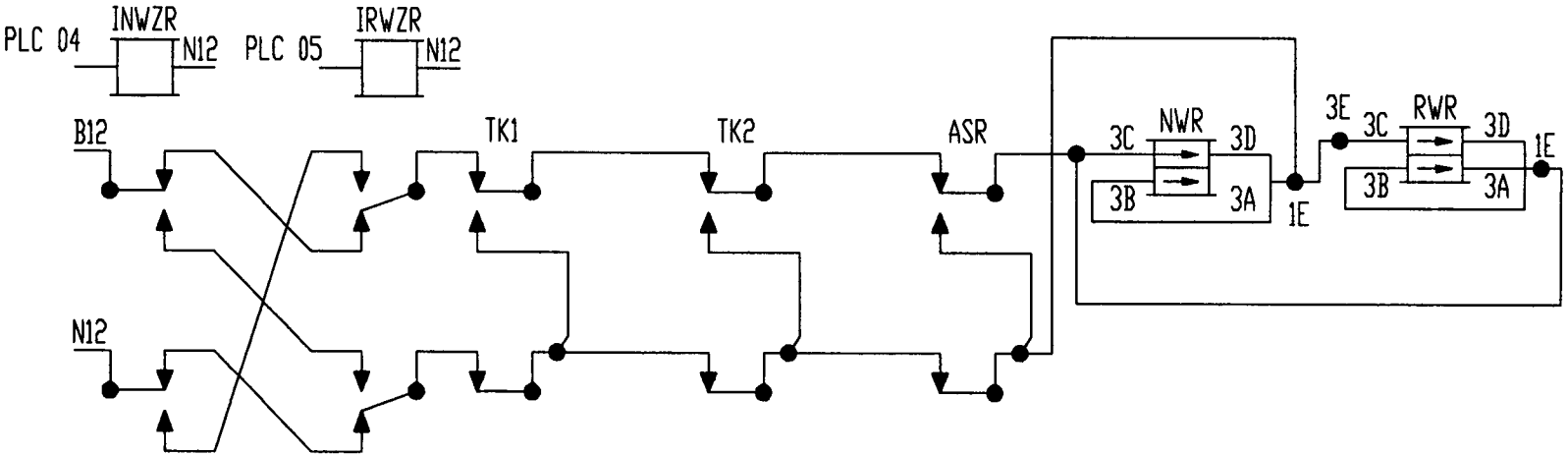
FIG. 1 is a block schematic of one embodiment of the invention's relays.

When reading this section (An Exemplary Embodiment of a Best Mode, which describes an exemplary embodiment of the best mode of the invention, hereinafter "exemplary embodiment"), one should keep in mind several points. First, the following exemplary embodiment is what the inventor believes to be the best mode for practicing the invention at the time this patent was filed. Thus, since one of ordinary skill in the art may recognize from the following exemplary embodiment that substantially equivalent structures or substantially equivalent acts may be used to achieve the same results in exactly the same way, or to achieve the same results in a not dissimilar way, the following exemplary embodiment should not be interpreted as limiting the invention to one embodiment.

Likewise, individual aspects (sometimes called species) of the invention are provided as examples, and, accordingly, one of ordinary skill in the art may recognize from a following exemplary structure (or a following exemplary act) that a substantially equivalent structure or substantially equivalent act may be used to either achieve the same results in substantially the same way, or to achieve the same results in a not dissimilar way.

Accordingly, the discussion of a species (or a specific item) invokes the genus (the class of items) to which that species belongs as well as related species in that genus. Likewise, the recitation of a genus invokes the species known in the art. Furthermore, it is recognized that as technology develops, a number of additional alternatives to achieve an aspect of the invention may arise. Such advances are hereby incorporated within their respective genus, and should be recognized as being functionally equivalent or structurally equivalent to the aspect shown or described.

Second, the only essential aspects of the invention are identified by the claims. Thus, aspects of the invention, including elements, acts, functions, and relationships (shown or described) should not be interpreted as being essential unless they are explicitly described and identified as being essential. Third, a function or an act should be interpreted as incorporating all modes of doing that function or act, unless otherwise explicitly stated (for example, one recognizes that "tacking" may be done by nailing, stapling, gluing, hot gunning, riveting, etc., and so a use of the word tacking invokes stapling, gluing, etc., and all other modes of that word and similar words, such as "attaching").

Fourth, unless explicitly stated otherwise, conjunctive words (such as "or", "and", "including", or "comprising" for example) should be interpreted in the inclusive, not the exclusive, sense. Fifth, the words "means" and "step" are provided to facilitate the reader's understanding of the invention and do not mean "means" or "step" as defined in §112, paragraph 6 of 35 U.S.C., unless used as "means for—functioning—" or "step for—functioning—" in the Claims section. Sixth, the invention is also described in view of the Festo decisions, and, in that regard, the claims and the invention incorporate equivalents known, unknown, foreseeable, and unforeseeable. Seventh, the language and each word used in the invention should be given the ordinary interpretation of the language and the word, unless indicated otherwise.

As will be understood by those of ordinary skill in the art, various structures and devices are depicted in block diagram form in order to avoid unnecessarily obscuring the invention. As used, herein and the accompanying drawings, B12 refers to positive 12 volts, and N12 refers to negative 12 volts. Additionally the term "set" refers to the application of 12 volts (B12), while the term "reset" refers to the removal of 12 volts.

Some methods of the invention may be practiced by placing the invention on a computer-readable medium. Computer-readable mediums include passive data storage, such as a random access memory (RAM) as well as semi-permanent data storage such as a compact disk read only memory (CD-ROM). In addition, the invention may be embodied in the RAM of a computer and effectively transform a standard computer into a new specific computing machine.

Data elements are organizations of data. One data element could be a simple electric signal placed on a data cable. One common and more sophisticated data element is called a packet. Other data elements could include packets with additional headers/footers/flags. Data signals comprise data, and are carried across transmission mediums and store and transport various data structures, and, thus, may be used to transport the invention. It should be noted in the following discussion that acts with like names are performed in like manners, unless otherwise stated.

Of course, the foregoing discussions and definitions are provided for clarification purposes and are not limiting. Words and phrases are to be given their ordinary plain meaning unless indicated otherwise.

Description of the Drawings

Overview

The present invention provides remote switch control utilizing Dual Tone Multiple Frequency (DTMF) control. Indications to a train (or, more properly, its crewmembers) are provided by single aspect, three color, switch point position indicators and pre-recorded audible messages transmitted via VHF/UHF radios. Preferably, the invention is "fully vital" (meaning sufficiently reliable to be called "vital" as the term is defined in the industry). From a functional point of view, the invention provides: switch locking based on time or occupancy, switch point position indicators, and audible messages for lined and locked normal and reverse positions.

Components

The exemplary embodiment may comprise these components/nomenclature:

1. Power Operated Switch: M23, 5H, or Power Operated Hydraulic Spring Switch
2. VHF/UHF Radio
3. DTMF Decoder
4. Individual Environmentally Resilient Radio Boards, one message per board
   Audio 1: Locked Normal Message
   Audio 2: Locked Reverse Message
   Audio 3: Not Lined Message
   Audio 4: Not Lined Message
   Audio 5: Restored to Normal Message
5. PLC: Controls Switch, Triggers Audio Messages, Starts Timer
6. Track Circuits (typically four (4) wire)
   OS1: Main Track over switch points
   OS2: Diverging/Siding Track
7. Timers
   15 Minute Approach
   10 Second Loss of Shunt (LOS) for Main Track
8. Relays
   NWP or NWR (Normal Switch Position Repeater): Driven by switch machine or power operated switch (M23, 5H), switch circuit controller or shelf point detection system on power operated spring switch.
   RWP or RWR (Reverse Switch Position Repeater): Driven by switch machine or power operated switch (M23, 5H), switch circuit controller or shelf point detection system on power operated spring switch.
   ASR (Approach Stick Relay): Used to lock switch machine while Approach Timer is running.
   TK1: Repeats OS1 with LOS. Locks Switch Machine.
   TK2: Repeats OS2. Locks Switch Machine.
   NWZ: Normal Switch Control
   RWZ: Reverse Switch Control Switch Locking Switch locking is provided by three relays shown in FIG. 1, which is a block schematic of one embodiment of the invention's relays. A first relay TK1 and a second relay TK2 repeat the first track circuit OS1 and the second track circuit OS2 as described in the above-referenced and incorporated patent application. With either or both relays "down", the switch cannot be controlled. In addition, the third relay ASR will lock the switch machine and is driven by the Approach Timer shown in FIG. 2.

Figure 2:
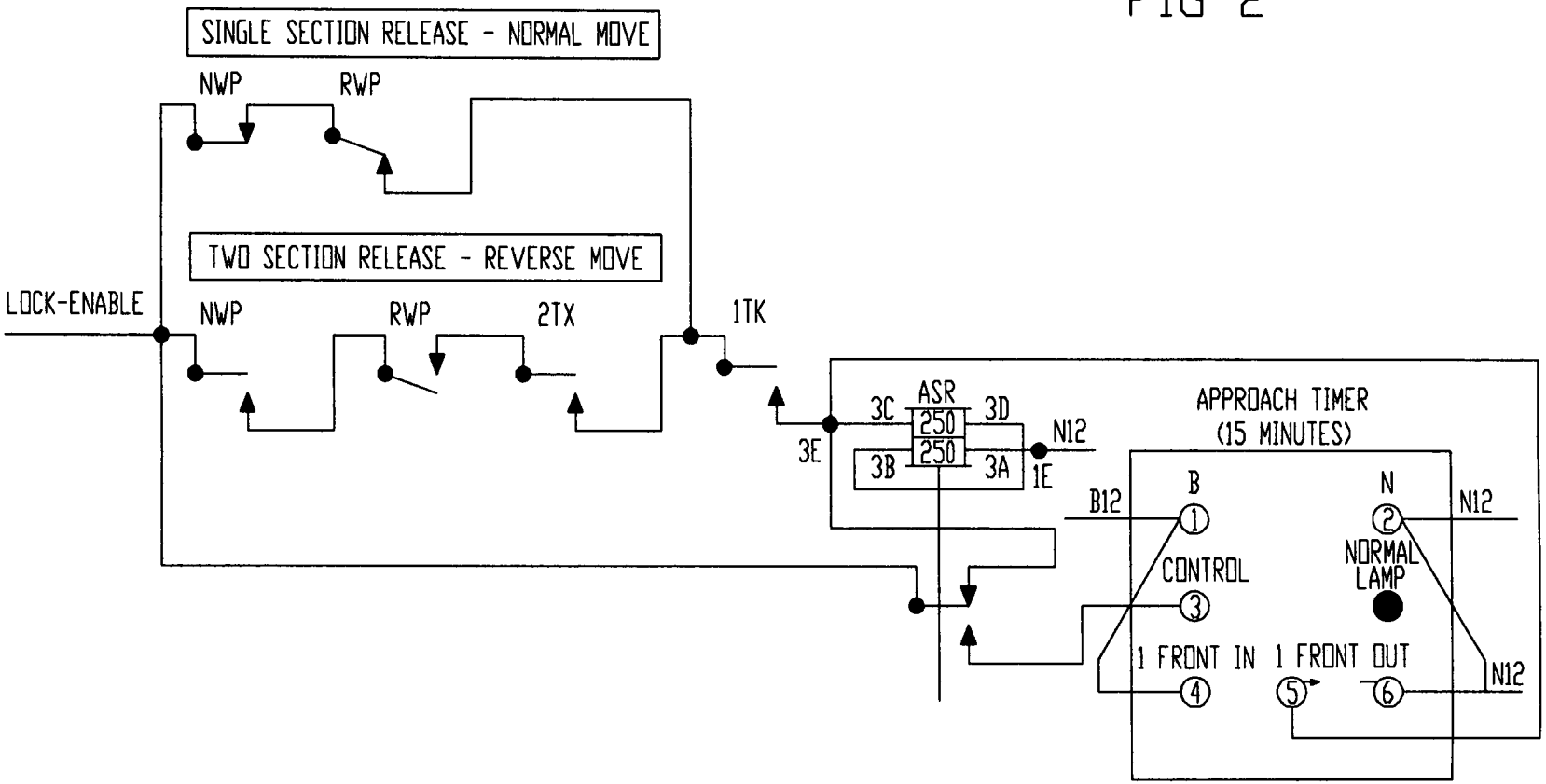
FIG. 2 is a block schematic of one embodiment of the approach timer circuit.

FIG. 2 is a block schematic of one embodiment of the approach timer circuit. The invention time locks the switch machine by the use of the third relay ASR. The third relay ASR is normally held "up" by its own contacts and is driven by the "LOCK ENABLE" output from the PLC (Programmable Logic Controller). Once the switch machine is in correspondence, the PLC momentarily drops the LOCK-ENABLE output which forces the third relay ASR to drop, which provides a path to the Approach Timer. The third relay ASR recovers via: 1) the expiration of the fifteen-minute Approach Timer, or 2) the first relay TK1 dropping on a normal move (single section release), or 3) the first relay TK1 and the second relay TK2 dropping on a reverse move (two section release). With the switch occupied, the ASR will recover, but the switch will continue to remain locked by the first relay TK1 and/or the second relay TK2.

Audio Messages

Figure 3:
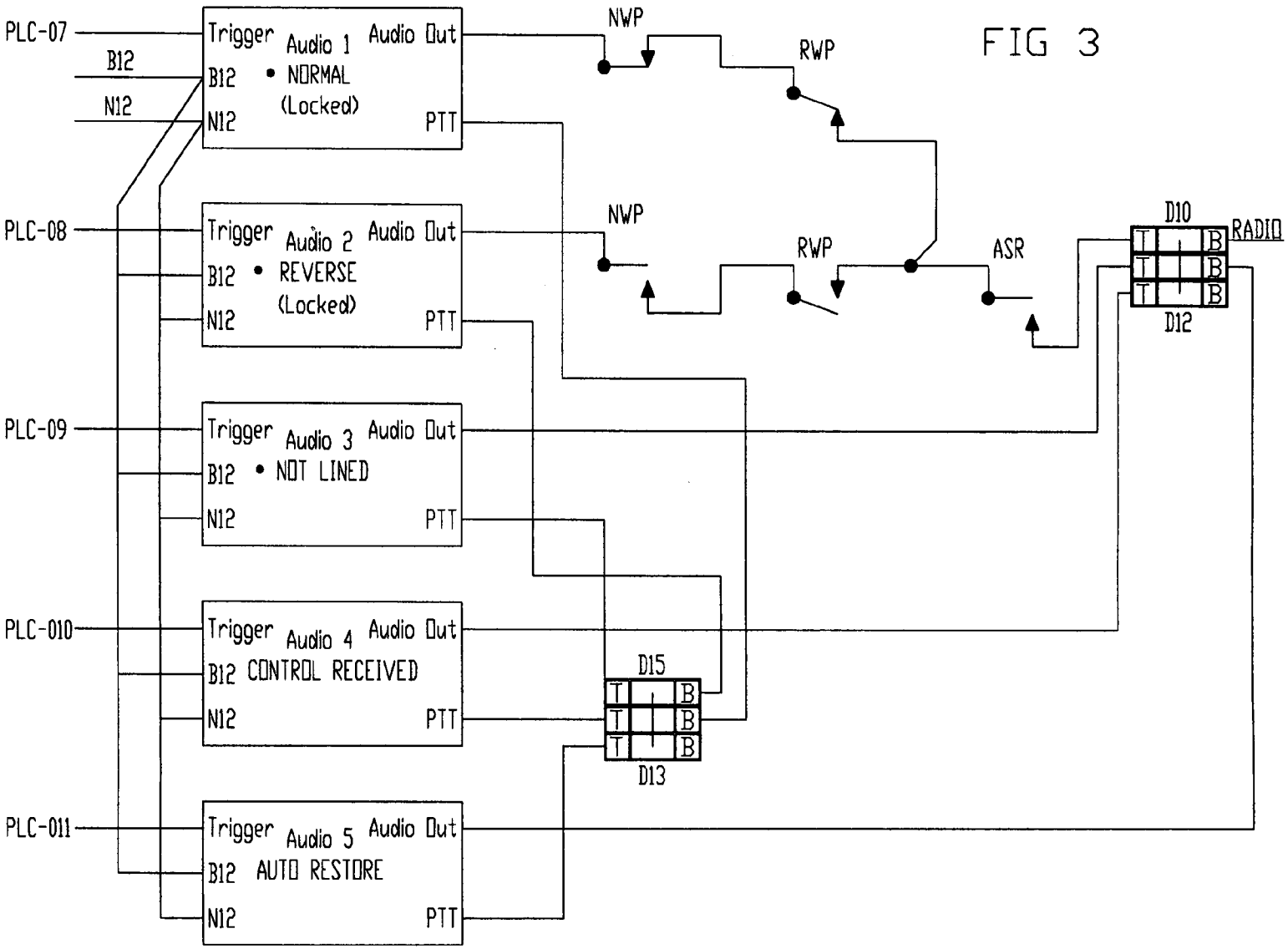
FIG. 3 is a block schematic of one embodiment of the audio message system.

The invention provides audio messages with vital reliability by use of discrete audio boards for the recording and playback of individual messages. Each audio board contains only one message, and is equipped with a trigger, audio output and push to talk output. Each audio board is also environmentally resilient, meaning that each board will operate in temperatures of greater than 120-degrees Fahrenheit, and less than zero-degrees Fahrenheit, and can operate in other recognized environmental extremes. The messages are triggered by the PLC. Routing the audio output of each board through the NWP, RWP and third relay ASR provide the vital audio functions as shown in FIG. 3, which is a block schematic of one embodiment of the audio message system.

For the Audio 1 message to be transmitted, the NWP must be up, the RWP must be down, and the third relay ASR must be down. This occurs only if the switch is in the normal position and the time is locked. For the Audio 2 message to be transmitted, the NWP must be down, the RWP must be up, and the third relay ASR must be down. This occurs if the switch is in the reverse position and the time is locked. The Audio 3 message, Audio 4 message, and Audio 5 messages can be transmitted at any time.

Accordingly, on a controlled normal move, the only valid message is the Audio 1 message. Any other message will require the train to approach prepared to stop. On a controlled reverse move, the only valid message is the Audio 2 message. All other messages require the train to approach prepared to stop.

Indicators

Figure 4:
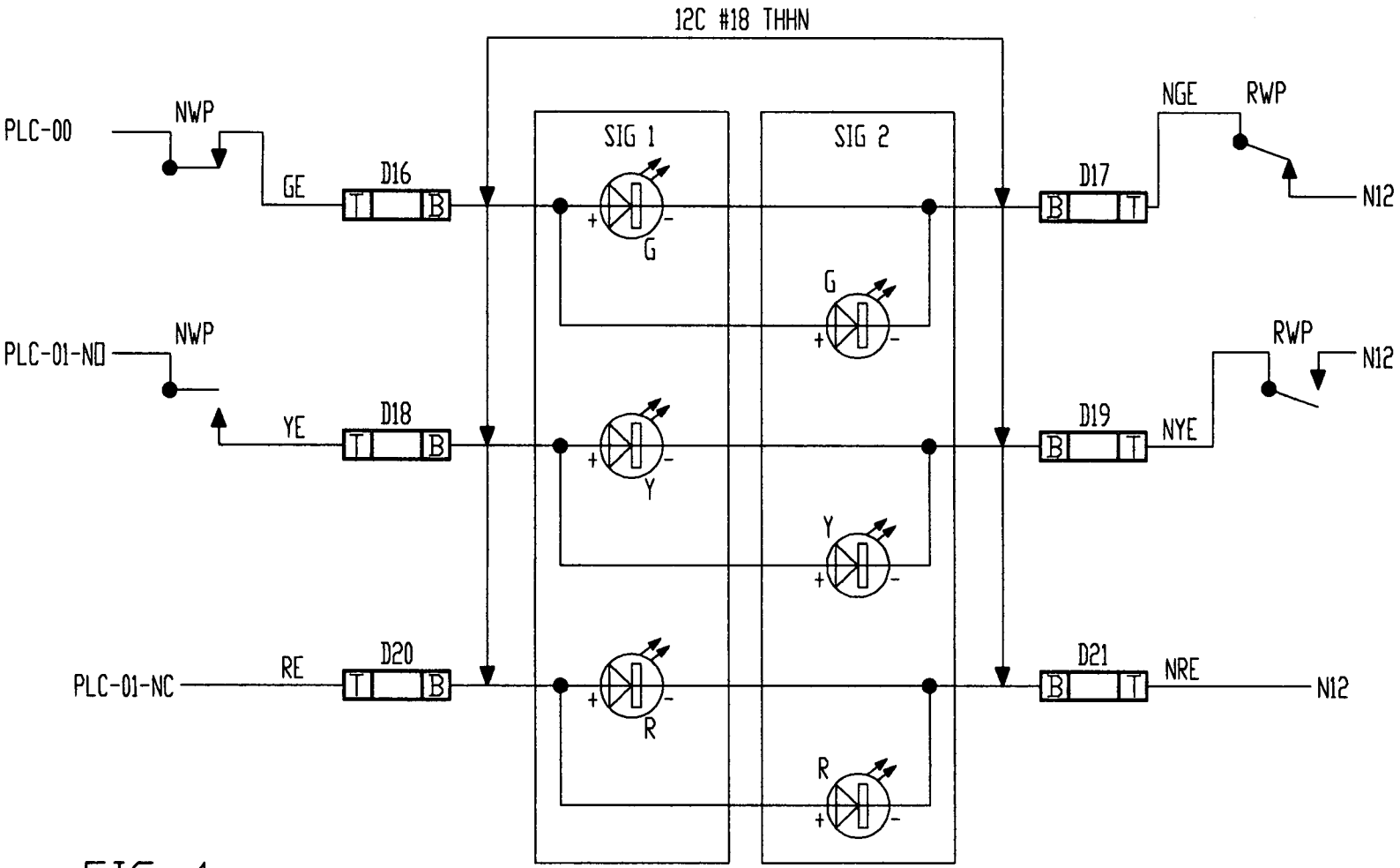
FIG. 4 is a block schematic of one embodiment of the vital switch point indicator system.

FIG. 4 is a block schematic of one embodiment of the vital switch point indicator system. The invention provides switch point position indicators by routing the PLC outputs for green (normal), and yellow (reverse) through the NWP and RWP relays. Thus, preferably, each of the indicators, the audio messages, and the switch locking are all "vital" rated.

Operation

The wireless controller system of the present invention is configured to perform the following operations: receiving a wireless dual tone multiple frequency (DTMF) signal, wherein the signal received by the system indicates a desired railroad switch position, validating the wireless signal, initiating the control of the switch, checking a relay to determine a relay status coupled to the railroad switch, checking a logic controller to determine a correspondence condition; and reporting a status of the railroad switch in the dark territory; and wherein the railroad switch does not have a switch signal system that is associated with a central dispatch system.

In operation, trains approaching an invention-equipped switch to be prepared to stop, unless the switch has been controlled and the correct indication (audio message and/or indicator) has been received. Thus, trains are required to control the location before all movements are made. Although distance from which the location must be controlled vary, the distance is typically two miles and is also typically identified with a passive control sign.

Once the location is controlled and in correspondence, the switch is time locked for fifteen (15) minutes. The location cannot be re-controlled until the time expires or is slotted off by the occupancy of the track circuits. Additionally, once the machine is locked, the correct message (Audio 1 or Audio 2) is transmitted and the appropriate indicators are displayed. By operating rule, the failure to receive a correct message including not receiving any message, requires trains to approach the location prepared to stop. If the switch machine fails to achieve correspondence, the Audio 3 message is transmitted, informing the crew that the switch is not lined correctly. Audio 4 is transmitted when using "slow speed switch machines" to inform the crew that the control information has been received and that the switch is moving.

Additional Safety Features

The invention continuously monitors the switch position once the switch has been time locked. Any loss of correspondence triggers the Audio 3 message. This message may optionally be repeated at regular intervals until the switch has been returned to correspondence. This provides continuous advance warning if the switch is tampered with after it has been controlled.

The invention also provides an optional Auto Restore. This feature will automatically return the switch to the normal position after a reverse move. Once the switch has been returned the system broadcasts the Audio 5 message (the switch restored message). The switch is not time locked after a restore and is available immediately for re-control.

Closing Caveat

Of course, it should be understood that the order of the acts of the algorithms discussed herein may be accomplished in different order depending on the preferences of those skilled in the art, and such acts may be accomplished as software, and that equivalent methods (and portions of methods) having equivalent or substantially similar ends may be substituted, and are readily apparent to those of ordinary skill in the art after reading this disclosure. Furthermore, though the invention has been described with respect to a specific preferred embodiment, many advantages, variations and modifications will become apparent to those skilled in the art upon reading the present application. It is therefore the intention that the appended claims and their equivalents be interpreted as broadly as possible in view of the prior art to include all such variations and modifications.

What is claimed is:

1. In a vital railroad switching system for dark territory, a method of wirelessly controlling a railroad switch in a track system that includes tracks in a dark territory, comprising:

providing audio boards including a plurality of audio messages, wherein each audio message is maintained on a discrete one of the audio boards, and each said board is equipped with at least a trigger and an audio output;

receiving a wireless dual tone multiple frequency (DTMF) signal indicating a desired railroad switch position;

validating the wireless signal;

initiating the control of the switch;

checking a relay to determine a relay status, the relay coupled to the railroad switch, the railroad switch not having a switch signal system that is associated with a central dispatch system;

checking a logic controller to determine a correspondence condition;

reporting the correspondence condition; and reporting a status of the railroad switch in a dark territory.

2. In a vital railroad switching system for dark territory, a system for wirelessly controlling a railroad switch in a track system that includes tracks in a dark territory, comprising:

audio boards including a plurality of audio messages, wherein each audio message is maintained on a discrete one of the audio boards, and each said audio board is equipped with at least a trigger and an audio output;

a programmable logic controller (PLC) for triggering each said audio message, and the PLC being coupled to the trigger of each said audio board;

wherein the system is configured to receive a wireless dual tone multiple frequency (DTMF) signal, and the signal received by the system indicating a desired railroad switch position;

the system is further configured to validate the wireless signal;

to initiate the control of the switch;

to check a relay to determine a relay status coupled to the railroad switch;

to check a logic controller to determine a correspondence condition;

to report the correspondence condition; and to report a status of the railroad switch in the dark territory; and wherein the railroad switch does not have a switch signal that is associated with a central dispatch system.

3. A method of wirelessly controlling a railroad switch in a track system that includes tracks in a dark territory, comprising:

providing a railroad switching system including a wireless control system of claim 2, and operating the railroad switch in the track system by using the wireless control system.

* * * * *